US006311745B1

(12) United States Patent
Welch et al.

(10) Patent No.: US 6,311,745 B1
(45) Date of Patent: Nov. 6, 2001

(54) SYSTEMS AND METHODS FOR DISPENSING POWDERS

(75) Inventors: Roger D. Welch, Fairport; Roman S. Kulik, Penfield, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/587,391

(22) Filed: Jun. 5, 2000

(51) Int. Cl.[7] ..... B65B 1/04

(52) U.S. Cl. ..... 141/346; 141/301; 251/149.9; 137/614; 137/614.01

(58) Field of Search ..... 141/346, 350, 141/351, 360, 362, 301, 67, 69; 137/614, 614.01; 251/149.9

(56) References Cited

U.S. PATENT DOCUMENTS 4,974,646 12/1990 Martin et al. .
5,295,507 * 3/1994 Bandy et al. ..... 137/614.06
5,540,266 * 7/1996 Grau et al. ..... 141/383
5,690,152 * 11/1997 Koch et al. ..... 141/346
5,727,607 3/1998 Ichikawa et al. .

OTHER PUBLICATIONS

Martin Kutz & Company, Inc., Dynapore (no date).
Serck Audco Valves, Contained Transfer Coupling (no date).

* cited by examiner

*Primary Examiner*—Steven O. Douglas
(74) *Attorney, Agent, or Firm*—Oliff & Berridge, PLC

(57) ABSTRACT

A dispensing system for containing and dispensing powders, such as toner and developers, includes a dispensing container having an outlet and a chamber that contains powder. A fluidizing system introduces a gas into the chamber to increase the fluidity of the powder. The dispensing system includes a valve having a first portion attached to the dispensing container, and a second portion that attaches to a receiving container that receives the powder dispensed from the dispensing container. The valve is operable to dispense the powder from the dispensing container to the receiving container. The fluidizing system includes a porous member in the chamber and a gas source that flows a gas into the chamber through the porous member to fluidize the powder and enhance dispensing of the powder.

33 Claims, 5 Drawing Sheets

SYSTEMS AND METHODS FOR DISPENSING POWDERS

BACKGROUND OF THE INVENTION

1. Field of Invention

This invention relates to the dispensing of powders. More particularly, this invention relates to apparatus and methods for dispensing powders.

2. Description of Related Art

Dispensing systems are used to dispense powders from a container into a receiving vessel. The container is typically attachable to the receiving vessel via a gasket arrangement during the dispensing operation. A dispensing valve controls the discharge of the powder from the container during dispensing operations. In such dispensing systems, if the gasket arrangement does not fit correctly, or if the container and receiving vessel are not perfectly aligned, then the powder tends to leak into the dispensing facility. This leakage of the powder can occur during dispensing, or after dispensing has been completed and the container and receiving vessel have been separated from each other. Depending on its composition, the leaked powder may cause health and safety concerns for persons in the facility. In addition, the leaked powder material can create housekeeping problems and results in material waste.

Furthermore, in such known dispensing systems, even when the gasket arrangement works correctly and leakage of the powder is well contained during the dispensing operation, subsequent leakage still occurs. For example, when the container and receiving vessel are separated from each other, powder that has adhered to the dispensing valve can become entrained in the air or drop onto the floor of the facility, causing the above-mentioned problems.

Another problem encountered in known powder dispensing systems is achieving a controlled flow of the powder from the container to the receiving vessel. Fine powders tend to agglomerate due to interparticle friction and electrostatic interaction of the powder particles. Known dispensing systems have addressed this flow problem by including fluidizing devices. For example, vibrators and flexible inflatable liners have been installed in known dispensing systems to improve the fluidity of the powder, so as to enhance feed control. However, although these fluidizing devices may enhance the flow of the powder, they have at the same time created additional problems. For example, the inflatable liners require venting of the air, which increases the complexity of the dispensing system. Inflatable liners can als be a source of fibers, which can contaminate the powder material. Accordingly, such fluidizing devices have not been completely satisfactory in known dispensing systems.

U.S. Pat. No. 4,974,646 to Martin et al. and U.S. Pat. No. 5,727,607 to Ichikawa et al., the entire disclosures of which are incorporated herein by reference, disclose apparatus for feeding powders that utilize members formed of porous materials to promote powder flow.

Thus, there is a need for a dispensing system for dispensing powders that can overcome these and other problems of known dispensing systems.

SUMMARY OF THE INVENTION

This invention provides a dispensing system for dispensing powders that can satisfy the above-described needs.

This invention separately provides a dispensing system that can be used to dispense powders with substantially complete containment of the powders.

This invention separately provides a dispensing system that can dispense powders at a suitably high dispensing rate.

This invention separately provides a dispensing system that has a simplified construction and is easy to operate.

This invention separately provides a dispensing system that is mobile.

This invention separately provides methods of dispensing powders.

Exemplary embodiments of the systems for containing and dispensing powders according to this invention comprise a dispensing container including a chamber having an outlet. A fluidizing system fluidizes the powder in the chamber to enhance the flow of the powder. The dispensing system comprises a valve including a first portion and a second portion. The first portion is attachable to the dispensing container at the outlet, and the second portion is attachable to a receiving container. The valve is operable to dispense the powder from the dispensing container to the receiving container.

Exemplary embodiments of the methods for containing and dispensing toner according to this invention comprise attaching a first portion of a valve attached to a dispensing container, which contains a powder, to a second portion of the valve attached to a receiving container. Gas is introduced into the dispensing container through a porous member to fluidize the powder. A valve is opened to dispense the powder from the chamber to the receiving container through a passage of the valve.

BRIEF DESCRIPTION OF THE DRAWINGS

Preferred embodiments of this invention will be described in detail, with reference to the following figures, in which.

DETAILED DESCRIPTION OF PREFERRED EMBODIMENTS

This invention provides a dispensing system that can dispense various different types of powders with substantially complete containment of the powders. The dispensing system can substantially completely contain powders during dispensing and also when the powder is not being dispensed. The dispensing system can reduce dust exposure to the surrounding space, thus reducing problems associated with such dust exposure.

Exemplary embodiments of the dispensing systems according to this invention include fluidizing systems that fluidize powders to enhance dispensing.

Exemplary embodiments of the dispensing systems according to this invention have a simplified construction and are easy to operate to dispense powders.

Exemplary embodiments of the dispensing systems according to this invention are mobile and can be used to dispense powders at different selected locations.

Exemplary embodiments of the dispensing system according to this invention can be used to dispense various powder materials. For example, the powders can be toner, developers, pharmaceuticals, cosmetics, foods, raw materials, mixtures thereof, or additives or components thereof. The dispensing system is particularly suitable for dispensing powder materials that have previously been difficult to dispense using known dispensing systems due to the poor flow properties of the powder materials. The dispensing systems according to this invention can be used to dispense such powder materials, in particular with greater dispensing efficiency and with less material leakage.

In addition, exemplary embodiments of the dispensing systems according to this invention are advantageous for dispensing powder materials that may cause health, safety and/or housekeeping problems if introduced into the surrounding environment. The dispensing systems according to this invention can contain such powder materials to reduce these and other problems.

Figure 1:
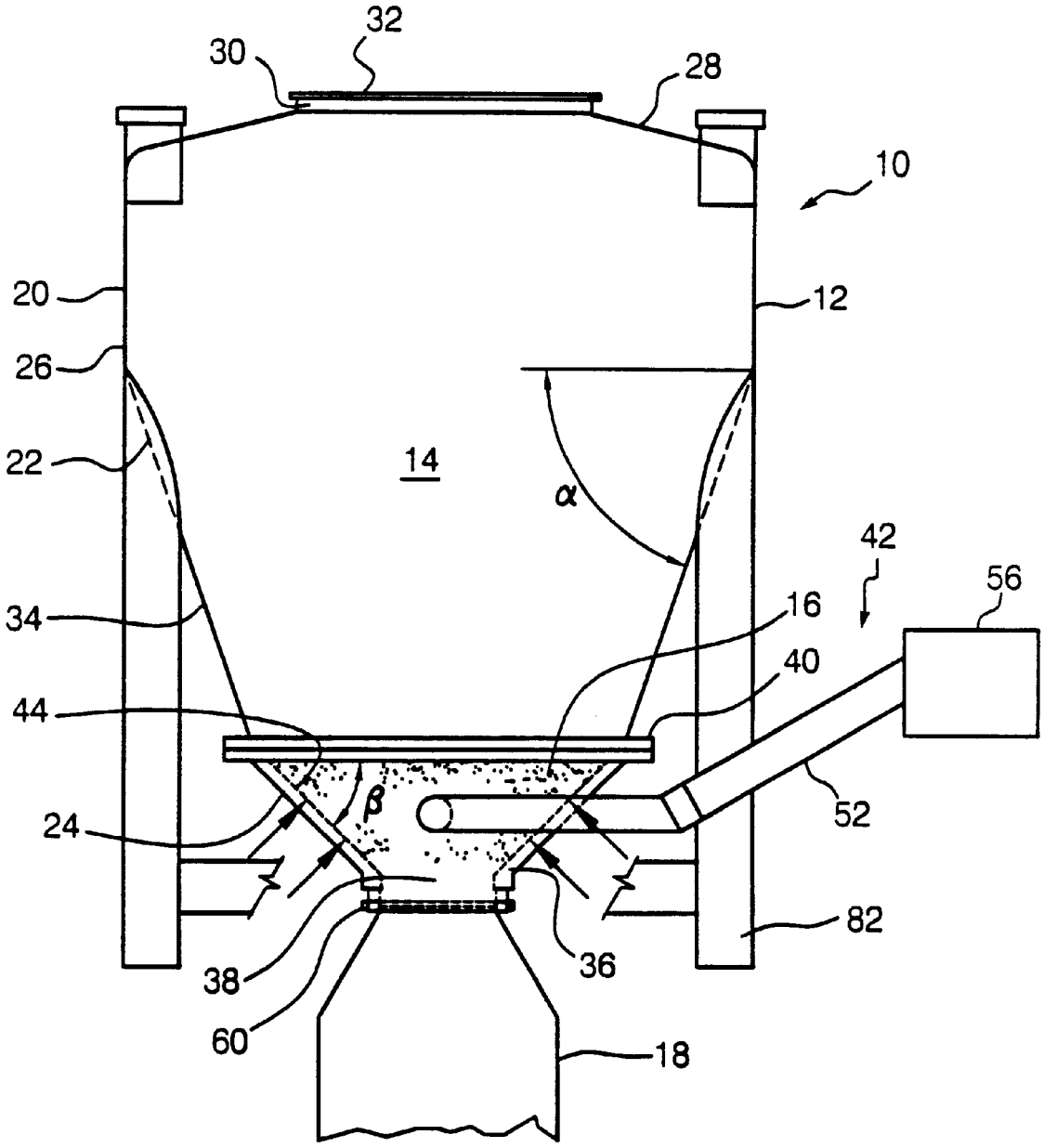
FIG. 1 illustrates an exemplary embodiment of a dispensing system according to this invention.

FIG. 1 illustrates an exemplary embodiment of a dispensing system 10 according to this invention. The dispensing system comprises a dispensing container 12 including a chamber 14. The chamber contains a powder 16. The powder 16 is dispensed from the dispensing container 12 to a receiving container 18 during dispensing operations.

Figure 2:
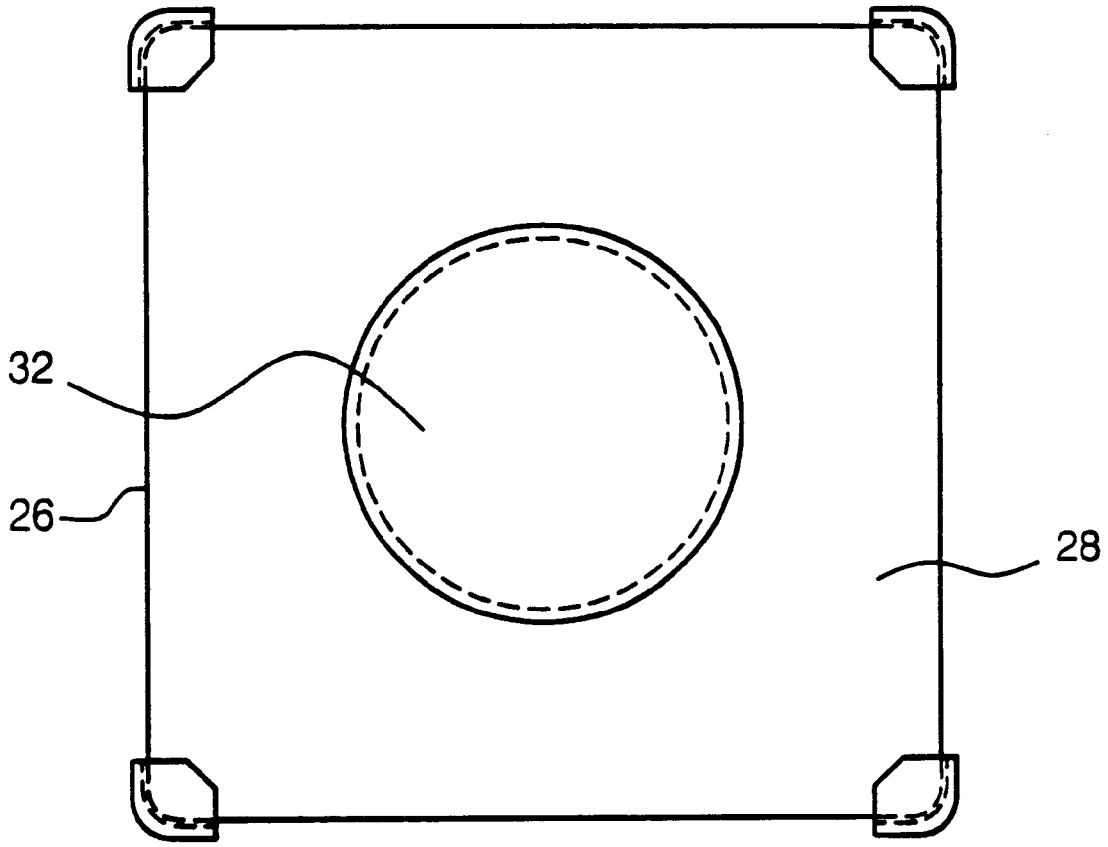
FIG. 2 is a top plan view of the dispensing system of FIG. 1.

As shown in FIG. 1, exemplary embodiments of the dispensing container 12 can include multiple sections. In an exemplary embodiment only, the dispensing container 12 includes an upper section 20, a middle section 22 and a lower section 24. The upper section 20 includes an upper wall 26. The shape of the upper wall 26 can be varied. For example, the upper wall 26 can have a square or rectangular shape as depicted in FIG. 2. In other exemplary embodiments of the dispensing system 10, the upper wall 26 can optionally have various other shapes, such as, for example, cylindrical or oval.

The upper section 20 further includes a top wall 28 having an opening 30 through which the powder 16 is filled into the chamber. A removable cover 32 is typically positioned over the opening 30 when the chamber 14 is not being filled with the powder, so as to prevent contamination of the powder 16 in the chamber 14 and/or to prevent any undesired escape of the powder 16 from the chamber 14.

The middle section 22 of the dispensing container 12 extends below the upper section 20. The middle section 22 includes a middle wall 34. The middle wall 34 typically has a conical shape, with a diameter that decreases from between the upper section 20 and the lower section 24 of the dispensing container 12. The middle wall 34 is oriented to direct the powder 16 toward the center of the chamber 14. The middle wall 34 typically is oriented at an angle a of about 70°. This angle can vary in embodiments of the dispensing system 10.

As shown, the upper section 20 and the middle section 22 of the dispensing container 12 can have a unitary construction. Alternatively, the upper section 20 and the middle section 22 can comprise separate sections, attached by any suitable attachment means.

The lower section 24 of the dispensing container 12 includes a lower wall 36. As shown, the lower wall 36 is inwardly oriented and its diameter decreases in the downward direction toward an outlet 38 of the dispensing container 12. The lower wall 36 typically is oriented at an angle β ranging from about 45° to about 70°, preferably from about 60° to about 70°, and more preferably about 70°.

As shown, in embodiments, the lower section 24 can be separate from the upper section 20 and the middle section 22. In such embodiments, the lower section 24 and the middle section 22 are attached together using any suitable type of fastener 40. This non-permanent attachment allows the lower section 24 to be removed for cleaning or repair purposes. It also allows lower sections 24 having different sizes, structures and/or configurations to be selectively installed on the dispensing container 12.

Alternatively, in other embodiments, the lower section 24 and the middle section 22 can be of a unitary construction, or can be permanently attached to each other such as by welding, soldering or the like.

The dispensing container 12 is formed of any suitable material that does not adversely interact with the powder 14. Typically, the dispensing container 12 is formed of a metal such as stainless steel. Other suitable metals, non-metallic materials and combinations of materials, can be used to form the dispensing container 12.

Figure 3:
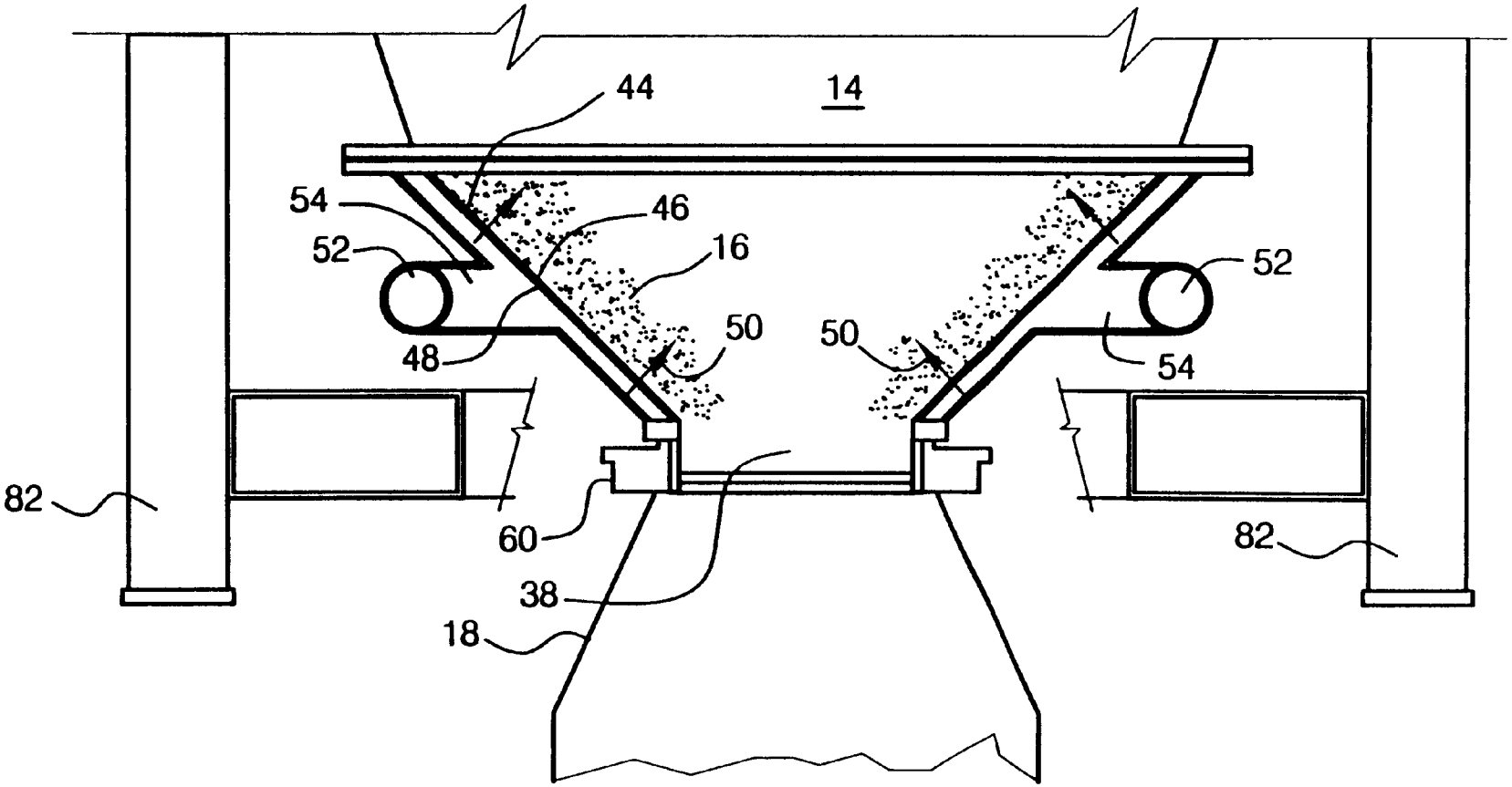
FIG. 3 is an enlarged view showing the bottom section of the dispensing container and the receiving container of FIG. 1.

The dispensing system 10 comprises a fluidizing system that enhances the fluidity of the powder 16 contained in the chamber 14, so as to enhance dispensing of the powder 16. In embodiments, the fluidizing system is provided at the lower section 24 of the dispensing container 12. The fluidizing system comprises a gas supply 42 and a porous medium 44. The porous medium 44 is disposed in the chamber 14 and includes a porous wall having an inner surface 46 and an opposite outer surface 48, as shown in FIG. 3. The gas supply 42 supplies a gas into the chamber 14, which flows through the porous medium 44 as depicted by the arrows 50. The gas forms a film over the inner surface 46 of the porous medium 44. The gas film enhances the movement of the powder 16 over the porous medium 44 and toward the outlet 38 of the dispensing container 12. The enhanced fluidity of the powder 16 provides enhanced control of the rate of dispensing of the powder 16 from the dispensing container 12. In addition, the fluidization system reduces clogging of the powder 16.

According to the invention, the gas used in the fluidizing system can be any suitable gas. Suitable gases include, but are not limited to, air, oxygen, nitrogen, argon, mixtures thereof, and the like. For example, nitrogen and/or argon may be preferred in embodiments where oxidation of the powder to be dispensed is a concern. In the fluidizing system, parameters such as flow rate, gas temperature, and the like can be appropriately controlled to provide desired dispensation from the container.

The porous medium 44 has a pore structure that preferably at least substantially prevents the powder 16 from passing through the wall from between the inner surface 46 and the outer surface 48. Consequently, the porous medium 44 at least substantially contains the powder 16 to the portion of the chamber 14 that is disposed inward of the inner surface 46 of the porous medium 44. By containing the powder 16 in this manner, leakage of the powder 16 from the dispensing container 12 is reduced.

Exemplary suitable porous media for use in the dispensing system 10 include porous metallic media, such as metallic filters and fluidizing media. These porous metallic media have controlled pore sizes and pore size distributions. In order to prevent passage of the powder 16 through the porous medium 44, the porous medium 44 can have a pore structure with a maximum pore size that is smaller than the size of the smallest powder particles contained in the chamber 14.

The porous medium 44 can also have a selected permeability coefficient to enable the gas to be flowed through the porous medium 44 and into the chamber 14 in a controlled manner. By controlling the gas flow, the fluidity of the powder 16 in the chamber 14 can be controlled. Based on the capabilities of the gas supply 42 of the fluidizing system, the pore structure of the porous medium 44 can be varied to either increase or decrease the flow rate of the gas to respectively increase or decrease the amount of fluidization of the powder 16.

Porous metal media also have sufficient strength and durability for extended use in the dispensing system 10. In addition, porous metal media can be formed into thin sheets or plates having a rigid construction and suitable transverse rupture strength. In such embodiments, the flat, rigid inner surface 46 of the porous medium 44 can enhance the movement of the powder 16 over the inner surface 46.

In addition, the composition of the porous medium 44 can be selected to provide chemical resistance to the powder materials contained in the chamber 14, to prevent undesirable reaction products from being formed and contaminating the powder 16. For example, the porous medium 44 can comprise stainless steels, such as sintered stainless steels.

Suitable exemplary porous metal media that can be used for the porous medium 44 are available from Martin Kurz & Company, Inc. of Long Island, N.Y.

The porous medium 44 is not limited to metallic materials and can be formed of any other suitable materials that provide the desired characteristics including pore structure, mechanical properties and chemical resistance. For example, the porous medium 44 can be formed of suitable ceramic materials or combinations of metals and ceramic materials that have these characteristics.

In embodiments, the gas supply 42 of the fluidizing system comprises one or more inlets 52 that include gas flow passages 54 through which the gas is flowed into the chamber 14 from a gas source 56. For example, the inlets 52 can comprise conduits. The gas source 56 can be any suitable pump, for example.

In embodiments, the gas source 56 can provide a selected gas flow rate of from about 0.1 bar to about 7 bar into the chamber 14. The gas flow rate can be selectively varied to control the level of fluidization of the powder 16 in the chamber 14.

The porous medium 44 can filter the gas flowed into the chamber 14 by the gas source 56 to prevent any undesirable substances from being introduced into the chamber 14.

The dispensing system 10 also includes a valve 60. The valve 60 is operable to dispense the powder 16 from the dispensing container 12 to the receiving vessel 18. The valve 60 enables the powder 16 to be dispensed from the dispensing container 12 in a controlled manner and with at least substantial containment of the powder 16 within the dispensing system 10.

Figure 4:
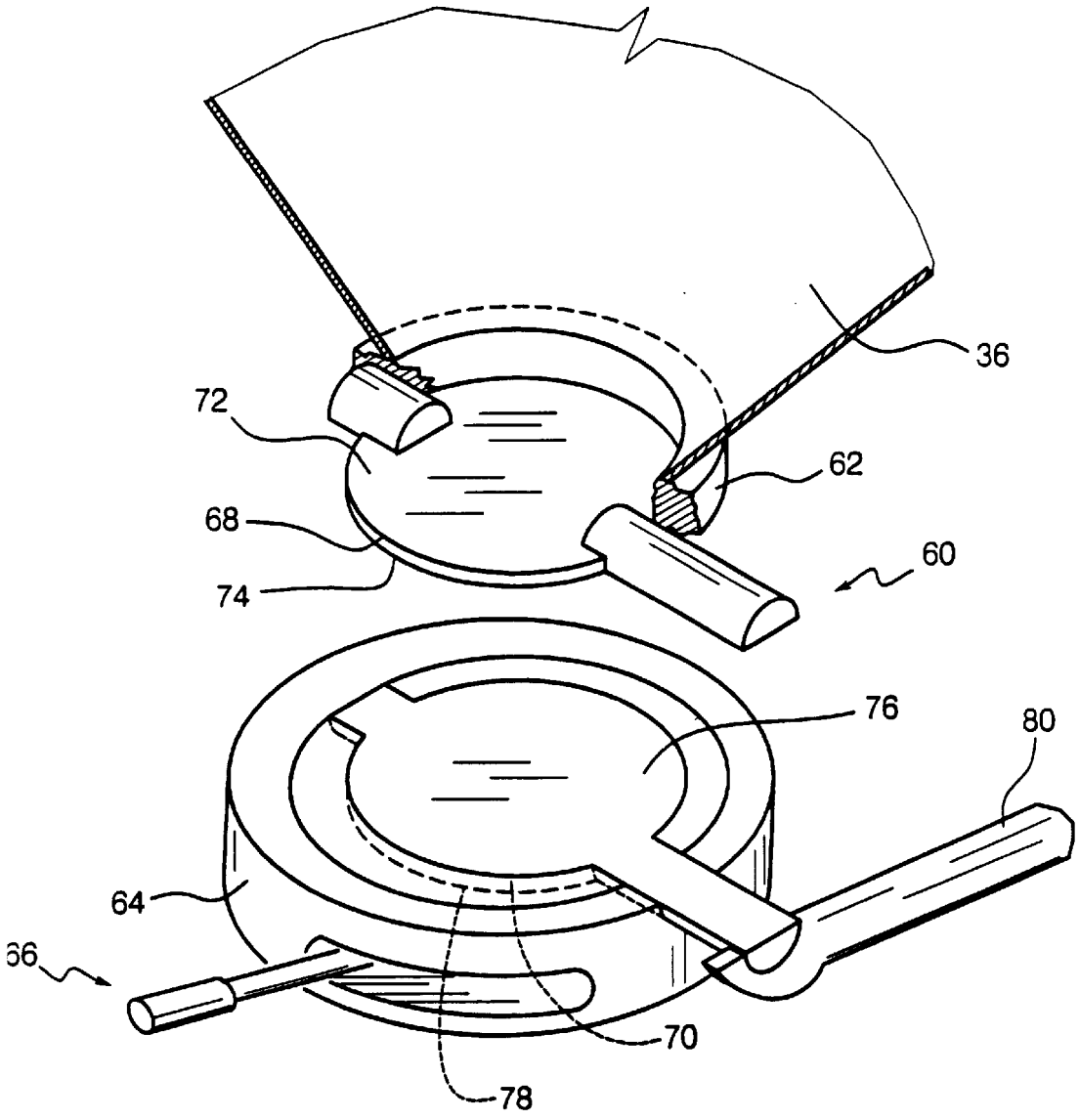
FIG. 4 is an exploded view showing the first and second portions of the valve, with the first and second disks in closed positions.
Figure 5:
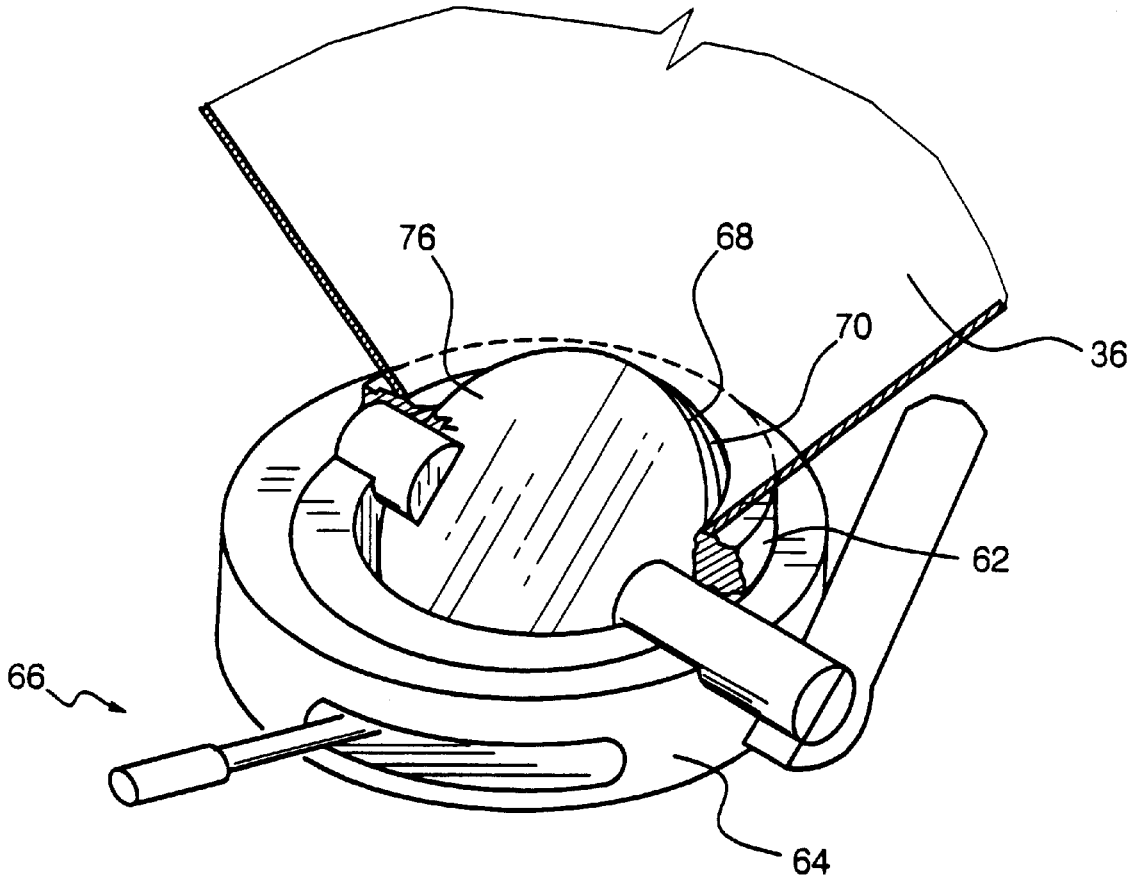
FIG. 5 shows the second portion of the valve with the second disk in an open position.

As shown in FIGS. 4 and 5, in embodiments, the valve 60 comprises a first portion 62 and a second portion 64. The first portion 62 is attached to the bottom end of the lower section 24 of the dispensing container 12. The second portion 64 is attachable to the receiving container 18 to which the powder 16 is transferred from the dispensing container 12. An exemplary suitable type of valve for use in the dispensing system 10 is a split discharge valve. Such valves are available from Serck Audco Valves of Houston, Tex.

In embodiments, the valve 60 can include a lock 66 that secures the first portion 62 to the second portion 64 in a locked condition, and allows the first portion 62 and second portion 64 to be separated from each other in an unlocked condition. The valve 60 is locked when the powder 16 is dispensed from the dispensing container 12 to the receiving container 18. The valve 60 is then unlocked after powder 16 has been dispensed. The lock 66 can comprise any suitable locking mechanism for this purpose. The first portion 62 and the second portion 64 can be quickly and easily coupled together for dispensing purposes and then separated after dispensing has been completed.

The first portion 62 of the valve 60 includes a first disk 68 and the second portion 64 includes a second disk 70. The first disk 68 includes a top face 72 and a bottom face 74. The second disk 70 includes a top face 76 and a bottom face 78.

The first disk 68 rotates between at least one closed position and at least one open position. Typically, the first disk 68 rotates over a range of about 90°, representing a range of open positions. In the closed position, the first disk 68 closes the outlet 38 of the dispensing container 12 and prevents the powder 16 from being dispensed from the dispensing container 12. In the open position(s), the powder 16 can be dispensed from the dispensing container 12 through the valve 60. By varying the open position of the first disk 68, the dispensing rate of the powder 16 from the dispensing container 12 can be selectively varied.

The bottom face 74 of the first disk 68 is configured to mate with the top face 76 of the second disk 70 in a face-to-face relationship when the first portion 62 is secured to the second portion 64 in the locked condition of the valve 60. When the first disk 68 and the second disk 70 are in this mating relationship, the first disk 68 and second disk 70 both move together between the closed position and the open position(s) of the valve 60.

In embodiments, the valve 60 can include a handle 80 that is operatively associated with the first disk 68 and/or the second disk 70. The handle 80 is provided on the second portion 64 of the valve 60 in the illustrated embodiment. The handle 80 is turned to rotate the first disk 68 and the second disk 70 to selectively open and close the valve 60.

In some embodiments, the valve 60 can be automatically controlled to open and close the valve 60 by pneumatic or electrical actuation.

When the first disk 68 and the second disk 70 are in a face-to-face relationship, the bottom face 74 of the first disk 68 is covered by the top face 76 of the second disk 70. Consequently, the bottom face 74 does not contact the powder 16 in either the closed position(s) or the open position(s) of the valve 60. Rather, only the top face 72 of the first disk 68 contacts the powder 16. The powder 16 is thus contained within the chamber 14 when the valve 60 is closed, and there is no powder 16 on the bottom face 74 that can drop onto the floor or become entrained in the surrounding air.

This containment of the powder 16 reduces waste of the powder 16 and also reduces the level of dust exposure of the powder 16 in the surrounding environment. Thus, the dispensing system 10 can reduce safety and health concerns and reduce shopkeeping problems associated with the presence of the powder 16 in the surrounding environment.

In embodiments, the container 10 comprises supports 82 for supporting the dispensing system 10 on a surface.

In some other embodiments, the dispensing system 10 can include rollers or the like on the dispensing container 12 to enable the dispensing container 12 to be pushed or rolled over a surface to different locations in a facility without having to be lifted.

Exemplary embodiments of the dispensing system 10 according to this invention can be sized to contain and dispense various amounts of powders, depending on the intended uses of the dispensing system 10. Typically, the dispensing container 12 has a height of from about 4 feet to about 6 feet. The chamber 14 of the dispensing container 12 is typically sized to contain from about 500 pounds to about 1000 pounds.

Of course, the dimensions of the dispensing container 12 are exemplary only, and are dependent upon a number of factors including the particular powder to be dispensed, density and other properties of the powder, space concerns, powder availability, and the like. Also, the dimensions of the dispensing container 12 can be varied depending on the type and size of receiving container 18 to which the powder is being dispensed. Based on these and other considerations, dispensing containers 12 of other dimensions can be readily prepared and used based on the present specification.

Exemplary embodiments of the dispensing system 10 according to this invention can dispense powders typically at a rate of from about 1000 lb/hr to about 20,000 lb/hr.

Of course, these powder dispensing rates are exemplary only, and are dependent upon a number of factors including size of the containers, size of the valve opening, density and other properties of the powder, and the like. Dispensing rates outside these ranges can be used, in embodiments.

The dispensing system 10 according to this invention is particularly suitable for dispensing toner. The toner can be either magnetic or non-magnetic toners, as desired. The toner also can be either a homogeneous product, or can be a mixture of component products. The toner can be pre-blended, extruded, ground, classified, blended or screened.

In addition, the dispensing system according to this invention can also be used to dispense developers and mixtures of toner and developers.

For example, when the dispensing system 10 is used to contain and dispense toner, the dispensing system 10 can contain the dust level of the toner in the surrounding environment to less than about 10 $\mu g/m^3$. This dust level is significantly below the current dust exposure guidelines and requirements in various industries, which are typically as high as about 400 $\mu g/m^3$. Thus, the dispensing system 10 can exceed the required performance levels in various applications.

In embodiments, the dispensing container 12 can be a toner hopper. The receiving container 18 can comprise any suitable container for receiving the toner. The receiving container can be rigid or flexible. For example, the receiving container can be various bags, rotary valves, feeders, hoppers and bins. It will be understood by those skilled in the art that other types of receiving containers 18 can also be used to receive the powder dispensed from the dispensing container 12.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. A dispensing system for containing and dispensing a powder, comprising:

a dispensing container including:

a first section, and a second section separably attached to the first section;

supports for supporting the dispensing container on a surface;

an outlet at the first section; and a chamber defined by the first section and the second section, the chamber containing a powder;

a receiving container that receives powder dispensed from the dispensing container;

a fluidizing system that fluidizes the powder in at least the first section of the chamber; and a valve, including:

a first portion attached to the first section of the dispensing container at the outlet; and a second portion that is attachable to the receiving container;

wherein the valve is selectively operable to dispense the powder from the dispensing container to the receiving container.

2. The dispensing system of claim 1, wherein the fluidizing system comprises:

a porous member disposed in the chamber, the porous member including a porous wall having a surface that directs the powder toward the outlet of the dispensing container; and a gas source that supplies a gas into the chamber such that the gas flows through the porous medium and fluidizes the powder.

3. The dispensing system of claim 2, wherein the porous member comprises a porous metal.

4. The dispensing system of claim 3, wherein the porous wall includes pores sized to prevent the passage of the powder through the porous wall.

5. The dispensing system of claim 1, wherein the valve is a split discharge valve.

6. The dispensing system of claim 1, wherein the valve further comprises a lock that (i) secures the first portion to the second portion in a locked condition, and (ii) allows the first portion and second portion to be separated from each other in an unlocked condition in which the dispensing container is separated from the receiving container.

7. The dispensing system of claim 6, wherein the first portion of the valve comprises a first disk which is movable between (i) a closed position in which the first disk closes a flow passage of the valve and prevents the powder from being dispensed from the dispensing container, and (ii) an open position in which the flow passage is open and the powder can be dispensed from the dispensing container through the valve.

8. The dispensing system of claim 7, wherein:

the first disk of the first portion of the valve includes a bottom face that faces external to the dispensing container in the closed position; and the second portion of the valve comprises a second disk including a top face that mates with the bottom face of the first disk in a face-to-face relationship when the first portion is secured to the second portion, and when the first disk is moved between the closed position and open second position, wherein the bottom face of the first disk does not contact the powder contained in the chamber in the closed position or in the open position.

9. The dispensing system of claim 1, wherein the supports comprise rollers to enable the dispensing container to roll on a surface.

10. The dispensing system of claim 1, wherein the dispensing container comprises a toner hopper containing a toner, and the receiving container is selected from the group consisting of bags, rotary valves, feeders, hoppers and bins.

11. The dispensing system of claim 1, wherein the second section comprises a middle section and an upper section, and the first section, middle section and upper section each having a different diameter.

12. A dispensing system for containing and dispensing toner, comprising:

a dispensing container including:

a first section, and a second section separably attached to the first section;

supports for supporting the dispensing container on a surface;

an outlet at the first section; and a chamber defined by the first section and the second section, the chamber containing a toner;

a receiving container that receives toner dispensed from the dispensing container;

a porous member disposed in the first section of the chamber, the porous member including a porous wall having a surface that directs the toner toward the outlet of the dispensing container;

a gas source that supplies a gas into the first section of the chamber such that the gas flows through the porous member and fluidizes the toner; and a valve, including:

a first portion attached to the first section of the dispensing container at the outlet; and a second portion attached to the receiving container, wherein the first portion and second portion of the valve are selectively attachable to each other to dispense the toner from the dispensing container to the receiving container, and the first portion and second portion are selectively detachable from each other to separate the dispensing container from the receiving container;

wherein the valve is selectively operable to dispense the toner from the dispensing container to the receiving container such that the toner is substantially contained in the dispensing system.

13. The dispensing system of claim 12, wherein the porous wall includes pores sized to prevent the passage of the toner through the porous wall.

14. The dispensing system of claim 12, wherein the valve is a split discharge valve.

15. The dispensing system of claim 12, wherein the valve further comprises a lock that (i) secures the first portion to the second portion in a locked condition, and (ii) allows the first portion and second portion to be separated from each other in an unlocked condition in which the dispensing container is separated from the receiving container.

16. The dispensing system of claim 15, wherein the first portion of the valve comprises a first disk which is movable between (i) a closed position in which the first disk closes a passage of the valve and prevents the toner from being dispensed from the dispensing container, and (ii) an open position in which the passage is open and the toner can be dispensed from the dispensing container through the valve.

17. The dispensing system of claim 16, wherein:

the first disk of the first portion of the valve includes a bottom face that faces external to the dispensing container in the closed position; and the second portion of the valve comprises a second disk including a top face that mates with the bottom face of the first disk in a face-to-face relationship when the first portion is secured to the second portion, and when the first disk is moved between the closed position and the open position, wherein the bottom face does not contact the toner contained in the chamber in the closed position or in the open position.

18. The dispensing system of claim 12, wherein the dispensing container comprises a toner hopper and the receiving container is selected from the group consisting of bags, rotary valves, feeders, hoppers and bins.

19. The dispensing system of claim 12, wherein the second section comprises a middle section and an upper section, and the first section, middle section and upper section each having a different diameter.

20. A method of dispensing a powder from a dispensing container to a receiving container, comprising:

providing a dispensing container including:

a first section, and a second section separably attached to the first section;

supports that support the dispensing container on a surface;

an outlet at the first section; and a chamber defined by the first section and the second section, the chamber containing a powder;

providing a receiving container that receives powder dispensed from the dispensing container;

attaching a first portion of a valve attached to the dispensing container to a second portion of the valve attached to the receiving container;

flowing a gas into the first section of the chamber through a porous member to fluidize the powder; and opening the valve to dispense the powder from the dispensing container to the receiving container through a passage of the valve.

21. The method of claim 20, wherein the gas is flowed into the chamber of the dispensing container by a fluidizing system, comprising:

the porous member disposed in the chamber, the porous member having a surface that directs the powder toward the outlet of the container; and a gas source that supplies the gas into the chamber through the porous member so as to fluidize the powder in the dispensing container.

22. The method of claim 21, wherein the porous member comprises a porous metal.

23. The method of claim 21, wherein the porous member comprises a porous wall including pores sized to prevent the passage of the powder through the porous wall.

24. The method of claim 20, wherein the valve is a split discharge valve.

25. The method of claim 20, wherein the valve further comprises a lock that (i) secures the first portion to the second portion in a locked condition, and (ii) allows the first portion and second portion to be separated from each other in an unlocked condition.

26. The method of claim 25, wherein the first portion of the valve comprises a first disk which is movable between (i) a closed position in which the first disk prevents the powder from being dispensed from the dispensing container, and (ii) an open position in which the powder can be dispensed from the dispensing container through the valve.

27. The method of claim 26, wherein:

the first disk of the first portion of the valve includes a bottom face that faces external to the dispensing container in the closed position; and the second portion of the valve comprises a second disk including a top face which mates with the bottom face of the first disk in a face-to-face relationship when the first portion is secured to the second portion, and when the first disk is moved between the closed position and the open position, wherein the bottom face of the first disk does not contact the powder in the chamber in the closed position or in the open position.

28. The method of claim 20, wherein the powder is a toner, the dispensing container comprises a toner hopper, and the receiving container is selected from the group consisting of bags, rotary valves, feeders, hoppers and bins.

29. The method of claim 20, wherein the powder comprises a mixture of the toner and a developer.

30. The method of claim 20, wherein the powder is substantially contained within the dispensing system during dispensing.

31. The method of claim 30, further comprising:

detaching the first portion of the valve from the second portion, wherein the powder is substantially contained within the dispensing container when the first portion and the second portion are detached from each other.

32. The method of claim 31, wherein the powder is a toner and the dispensing system contains the toner such that the dust level of the toner in a surrounding environment is less than about 10 $\mu g/m^3$.

33. The method of claim 20, wherein the second section comprises a middle section and an upper section, and the first section, middle section and upper section each having a different diameter.

* * * * *